US005982261A

United States Patent [19]

Stowe

[11] Patent Number: 5,982,261

[45] Date of Patent: Nov. 9, 1999

[54] TUBE MAGNET ASSEMBLY WITH END-ROLLED CAPTURE TECHNIQUE

[75] Inventor: Michael W. Stowe, Boyne City, Mich.

[73] Assignee: Industrial Magnetics, Inc., Boyne City, Mich.

[21] Appl. No.: 09/110,985

[22] Filed: Jul. 7, 1998

Related U.S. Application Data

[60] Provisional application No. 60/052,149, Jul. 10, 1997.

[51] Int. Cl.[6] ..... H01F 7/02

[52] U.S. Cl. ..... 335/306; 210/222

[58] Field of Search ..... 335/302, 303, 335/304, 305, 306; 210/222, 223, 695, 538

[56] References Cited

U.S. PATENT DOCUMENTS

| | | | |
|---|---|---|---|
| 3,171,806 | 3/1965 | Schaffner | 210/223 |
| 5,188,239 | 2/1993 | Stowe . | |
| 5,378,362 | 1/1995 | Schoepe | 210/222 |

*Primary Examiner*—Lincoln Donovan
*Attorney, Agent, or Firm*—Young & Basile, P.C.

[57] ABSTRACT

A cylindrical tube magnet assemblies and their manufacture by the end-rolled capture technique. The assemblies are particularly useful in industrial separators wherein so-called tramp metals are passed through a conduit or hopper provided with a metal separation device comprising a plurality of cylindrical tube magnets typically contained in stainless steel tubes and used in grates, drawers, and stand-alone applications.

4 Claims, 2 Drawing Sheets

TUBE MAGNET ASSEMBLY WITH END-ROLLED CAPTURE TECHNIQUE

This application claims benefit of provisional application Ser. No. 60/052,149 filed Jul. 10, 1997.

FIELD OF THE INVENTION

The present invention relates to the manufacture of cylindrical tube magnet assemblies that are particularly useful in industrial separators wherein so-called tramp metals are passed through a conduit or hopper provided with a metal separation device comprising a plurality of cylindrical tube magnets typically contained in stainless steel tubes.

BACKGROUND OF THE INVENTION

Tube magnets are often used in industrial separators wherein so-called "tramp" metals are passed through a conduit or hopper, one end of which is provided with a metal separation device. It is well known to place a plurality of cylindrical magnet assemblies within the flow path of a material, such as a liquid, granulated or powdered material, and as the material passes through the conduit and through the magnet separator, any ferrous metal material within the flowing material will adhere to the magnets. Periodically, the magnets must be removed from the separator in order that the tramp metals may be cleaned from the metal separation device. Once the captured tramp metals have been removed from the surface of the magnets, the magnets are reinstalled in the separator, and the flow of material through the conduit is continued.

The cylindrical magnet assemblies are well known, as are the entire separator assemblies. Likewise, the cylindrical magnets are assembled of well known components. Typically, the cylindrical magnet assemblies comprise a stainless steel tube into which are placed a plurality of non-magnetic pieces and magnets in an alternating arrangement stacked within the tube. Once the requisite number of magnets have been installed inside the tube, a plug is fitted on the end of the tube, and the plug and tube are secured together by welding. The welding may be as simple as a two point spot weld on opposite sides of the magnet, or the welding may be more elaborate such as welding the entire circumference of the end plug to the inner circumference of the cylinder.

The associated welding process has a number of serious problems. First and most important, the magnet materials used in these tube magnets are now commonly neodymium, a rare earth magnet which is very temperature-sensitive. Temperatures above 180° will permanently destroy a neodymium magnet, and the welding process can easily create temperatures in excess of these amounts. The welding process is also costly and time-consuming and produces a rough and unattractive joint. The joint can be machined and dressed, but this adds additional steps to the process, and the appearance of the joint is still rough.

Another feature required of these assemblies is that the end plug be secured to the cylinder to prevent rotation of the end plug with respect to the magnetic assembly. This is because the end plugs are sometimes manufactured with a threaded hole in which the magnets are secured to a magnetic separator housing. Accordingly, the end plugs must be prevented from rotating with respect to the cylindrical housing.

Other techniques have been attempted to replace the welding process. One such process mechanically folds over the end of the tubes using a dimpling machine. This type of closure is unsightly and does not provide a reliable mechanical connection between the plug and the cylinder wall. Also, attempts to dimple the enclosure are impeded by the lack of elasticity in the magnets and non-magnetic pieces which fill the tube. Since these magnets and non-magnetic pieces have essentially no resilience, dimpling is generally unsuccessful.

It is known from U.S. Pat. No. 5,188,239 to use tube magnet assemblies with a metal separation device comprising a housing, magnetic drawer, and a drawer plate.

The plurality of magnets are formed as solid cylinders. A like number of stainless steel hollow cylinders, having a wall thickness of approximately one-sixteenth of an inch, are provided as containers for the magnets. The magnetic cylinders are press fit into the stainless steel cylinders. Stainless steel is used throughout the magnetic drawer assembly (including a bracket and fasteners), since it is non-magnetic and does not interfere with the magnetic fields generated by the internal magnets. The stainless steel cylinders also provide a mechanical protection to the magnets, which can be quite soft, brittle and subject to breakage. Lastly, the stainless steel cylinders provide a base for the fasteners to engage in securing the magnets on the drawer plate.

The magnets are preferably formed from various materials depending on the specific application or use intended. For example, a magnetic ceramic material may be used for a variety of applications since such materials are relatively inexpensive and have good magnetic properties for trapping both small and large metallic foreign matter. For high heat applications, an alnico magnetic material is better suited to an elevated temperature environment. Further, where it is crucial to separate even relatively small foreign particles from the raw material a magnetic neodymium material, such as a neodymium-iron-boron composition, should be used to produce a stronger magnetic field capable of attracting small particles.

To facilitate attachment of the magnets to the drawer plate, the magnets are formed of a suitable magnetic material pressed into a hollow, thin-walled, cylindrical, stainless steel casing, e.g., stainless steel 304. The stainless steel casing protects the magnetic inner core from damage and allows for relatively easy attachment of the magnets to the drawer plate, while not interfering with the magnetic properties of the inner magnetic core.

It is therefore an object of the invention, because of the above problems, to provide an improved end-sealed cylindrical magnetic tube housing assembly of which the assembly elements are mechanically secure to each other in a tight fit that prevents relative rotation of the elements to one another, which assembly is adapted to remove extraneous tramp metals from the product flow through a metal separation device.

It is also an object of the invention to provide a method of making a magnet tube and non-magnetic piece assembly in an alternating arrangement in a stainless steel cylinder having an open end, using the end-rolled capture technique. When the assembly is complete, a resilient compressible gasket means such as a silicone or rubber gasket is placed in the cylinder open end alongside the last non-magnetic piece preferably in diameter-matching relation, and an end plug is placed in the open end of the cylinder alongside the gasket means. The open end of the cylinder is placed in a cold-roll forming tool which advanteously both gradually crimps the end of the cylinder into a cylinder sealing relation and at the same time places inward axial pressure on the gasket means thus causing the resilient gasket to engage the non-magnetic pieces and magnets in a mechanically tight fit so that the end plug is prevented from rotating with respect to the end seal and other elements of the assembly.

BRIEF DESCRIPTION OF THE DRAWINGS

These and other objects and aspects of the invention will become apparent in the following detailed description of the invention with respect to the drawings in which.

DETAILED DESCRIPTION OF THE PREFERRED EMBODIMENTS OF THE INVENTION

Figure 1:
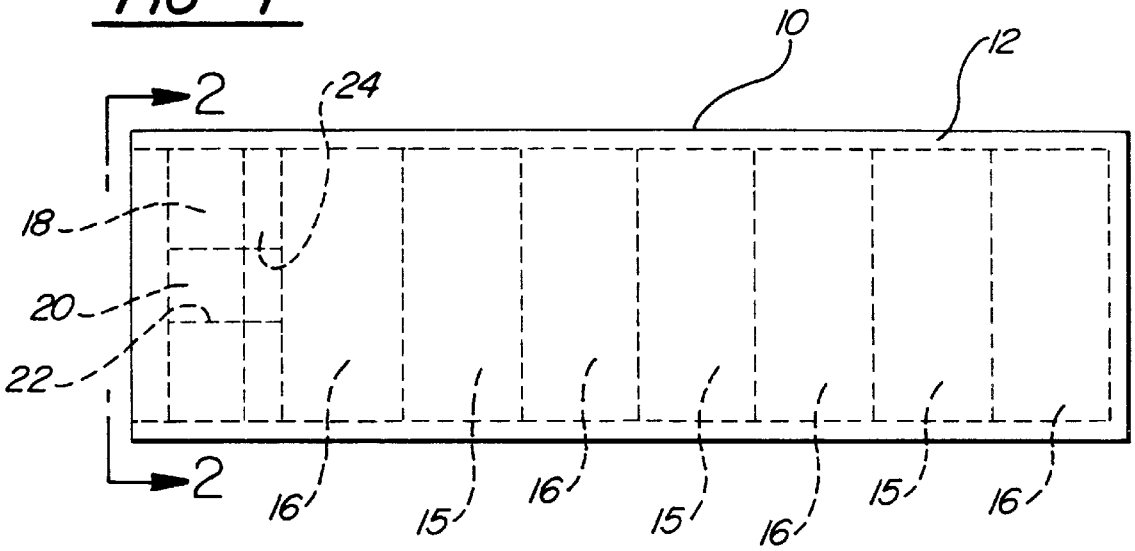
FIG. 1 is a side elevational view of a cylindrical tube magnet assembly having an open end containing a compressible O-ring and an end plug.

Referring to FIG. 1, there is shown a side view of a cylindrical tube magnet assembly 10 including a non-magnetic metal tube 12 preferably made of stainless steel, preferably stainless steel 304 and preferably having a wall thickness suitable for open-end forming by the end rolled technique such as about 1/16 inches. A tube end opening 14, magnets 15, non-magnetic pieces 16, an O-ring gasket 24, and an end plug 18.

Figure 2:
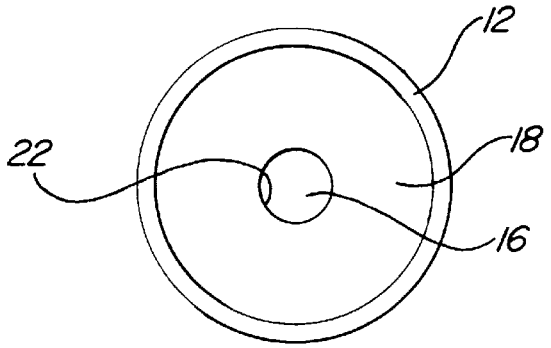
FIG. 2 is an end view of the cylindrical tube magnet assembly taken on line 2—2 of FIG. 1.

Referring to FIG. 2, there is shown an end view of the assembly 10 including the non-magnetic tube 12, the end non-magnetic piece 16, the end plug 18, the plug hole 20, and the plug hole threaded surface 22.

Figure 3:
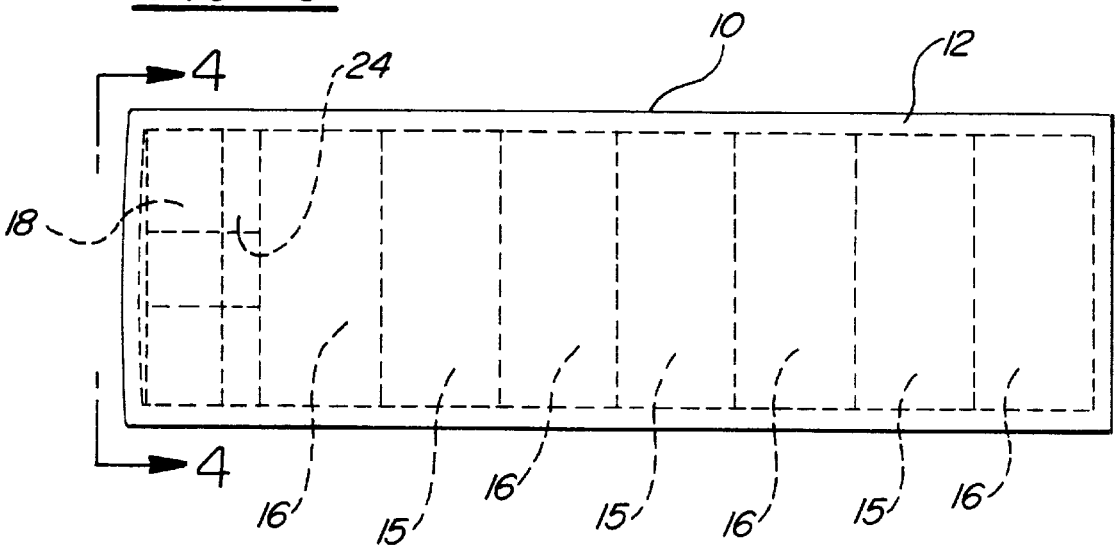
FIG. 3 is a side elevational view of a completed cylindrical tube magnet assembly containing a compressible O-ring and an end plug and having a roll-formed closed end that both seals the tube assembly and compresses the O-ring such that the end plug is prevented from rotating with respect to the completed assembly.

FIG. 3 shows a side view of a cylindrical tube magnet assembly 26 of which one end is sealed by a peripheral end-rolled capture surface 28.

Figure 4:
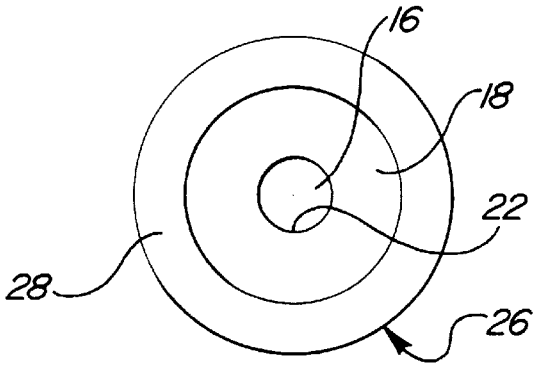
FIG. 4 is an end view of the cylindrical tube magnet assembly taken on line 4—4 of FIG. 3.

FIG. 4 shows an end view of the scaled cylindrical tube magnet assembly 26 of which the end 26 is sealed by a peripheral end-rolled capture surface 28, resulting in the consequent compression of the O-ring 25 that assures a axial tight fit of the assembly elements such that the end plug 18 does not rotate with respect to the assembly 10. With the peripheral surface, the end non-magnetic piece 16 and the end plug 18 are shown through the plug hole 20. The location of the surface of the plug hole threading 22 to enable screw thread attachment to a separator drawer plate is also shown. In one preferred embodiment, the end plug 18 can be replaced by a non-magnetic piece 16 (preferably with axially central thread means) in combination with a cooperating compressible gasket element such as an O-ring or disk to enable the desired prevention of rotation of the non-magnetic piece with respect to the end-rolled assembly 26.

The invention in which an exclusive property or privilege is claimed is defined as follows:

1. Magnetic cylinders in a set accommodating and in combination with a tramp metal separation device adapted to trap extraneous tramp metal traveling in a path directed through a conduit or hopper provided with said metal separation device, said cylinders each comprising a non-magnetic tube containing a) a plurality of magnets, b) a plurality of non-magnetic pieces in an alternating arrangement stacked within said tube, c) resiliently compressible gasket means, and d) an end plug at an open end of each of said magnetic cylinders, each said cylinder being sealed at said open end by axially inward forming pressure upon said open end thereby causing formation of a peripheral end-rolled surface into a sealing relation with each such magnetic cylinder and further causing said end plug element to be forced upon and thereby compressing said resilient gasket means to the extent that assures an axial tight fit of each magnetic cylinder so that each said end element means is mechanically and sealingly secure to said cylinder and is prevented from rotating with respect to said cylinder, said tramp separation device comprising a housing, a magnetic drawer including a bracket and fastener and a drawer plate, said housing being adapted to receive therein said magnetic drawer and magnetic cylinders in a set and to permit withdrawal of the magnetic drawer from the housing and permit withdrawal of the drawer plate from the withdrawn magnetic drawer to accomplish separation of the extraneous tramp metal from said magnetic cylinders.

2. Magnetic cylinders in a set accommodating and in combination with, a tramp metal separation device as in claim 1 wherein the gasket means is a compressible O-ring.

3. Magnetic cylinders in a set accommodating and in combination with, a tramp metal separation device as in claim 1 wherein the gasket means is a compressible disk.

4. Magnetic cylinders in a set accommodating and in combination with, a tramp metal separation device as in claim 1 wherein the end element means is adapted for threadable attachment to a drawer plate.

* * * * *